United States Patent [19]

Nakanishi

[11] 4,036,039

[45] July 19, 1977

[54] SASH LOCK

[76] Inventor: Yoshitaka Nakanishi, 12-9, Yawata 5-chome, Ichikawa, Chiba, Japan

[21] Appl. No.: 643,945

[22] Filed: Dec. 24, 1975

[30] Foreign Application Priority Data

Dec. 28, 1974 Japan ..... 50-2435[U]

[51] Int. Cl.[2] ..... E05B 63/14; E05B 47/00

[52] U.S. Cl. ..... 70/90; 70/216; 292/111; 292/240

[58] Field of Search ..... 70/89, 90, 215, 226; 292/111, 202, 340, 240, 241

[56] References Cited

U.S. PATENT DOCUMENTS

| | | | |
|---|---|---|---|
| 462,474 | 11/1891 | Aingee | 70/90 X |
| 659,069 | 10/1900 | Ives | 292/111 |
| 2,262,946 | 11/1941 | Kistner | 70/90 |
| 3,034,328 | 5/1962 | Rifkin | 70/90 |
| 3,277,677 | 10/1966 | Hurvitz | 292/111 X |

*Primary Examiner*—J. Franklin Foss

*Attorney, Agent, or Firm*—Robert E. Burns; Emmanuel J. Lobato; Bruce L. Adams

[57] ABSTRACT

Sash lock comprising a rotatable latch cam engageable with a keeper, a locking member for unlockably locking the latch cam to control the rotation of the latch cam, and an actuating member for shifting the lock member to a locked position or an unlocked position, wherein said actuating member is rotated by means of a key.

15 Claims, 11 Drawing Figures

SASH LOCK

BACKGROUND OF THE INVENTION

This invention relates to a sash lock, particularly to a sash lock, wherein a latch cam may be locked when said latch cam is engaged with a keeper.

An object of this invention is to provide a sash lock which may lock the latch cam and may not easily be opened from outside.

Another object of this invention is to provide a sash lock which may easily be locked or unlocked from inside by means of a key.

Still another object of this invention is to provide a sash lock which has a latch cam of simple, compact and strong structual while its external appearance is fine and its locking and unlocking is easy.

SUMMARY OF THE INVENTION

According to this invention, there is provided a sash lock which comprises a rotatable latch cam pivoted to a base and engageable with a keeper, a locking member for locking and unlocking the latch cam, a rotatable actuating member for shifting the locking member to a locked position or an unlocked position, and a key for rotating the actuating member.

BRIEF DESCRIPTION OF THE DRAWINGS

These and other objects as well as characteristics of this invention will be apparent to persons skilled in the art from the study of the following description with reference to the accompanying drawings, in which.

DESCRIPTION OF PREFERRED EMBODIMENTS

Figure 1:
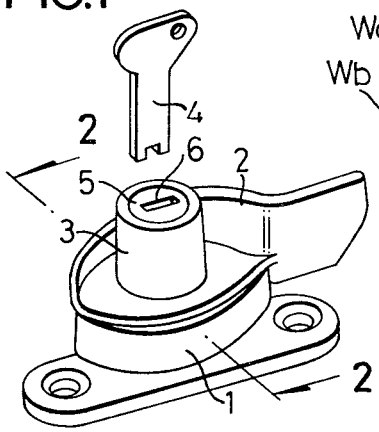
FIG. 1 is a perspective view of a sash lock according to this invention, showing it in a state where it has an unlocked latch cam.

Referring to FIG. 1, there is shown a sash lock comprising a base member 1, having holes for screws (not shown) for securing this member to a first sash member. A latch cam 2 is pivoted to the base member for latching this member to a second sash member. The sash members are well known and are not shown. The latch cam can be engaged with a keeper (not visible in this figure. There is also provided a casing 3 to cover a means for locking the latch cam from rotating relative to the base member. As shown in FIG. 1 the latch cam 2 is in a rotatable state relative to the base member 1, namely in an unlocked state. In this unlocked state, when a key 4 is inserted into a key hole 6 of a rotatable barrier disk 5 lying in the top of the casing 3 as shown, and when the key is turned clockwise, then a locking means within the cylinder acts in such a manner that the latch cam 2 can not be rotated relative to the base member 1. In the so established locked state, when the key 4 is turned counter-clockwise, the latch cam 2 is unlocked so that it may be rotated relative to the base member 1. In the unlocked state of latch cam 2, the latch cam can be turned nearly 180° to engage with the keeper or to disengage therefrom.

Referring to FIG. 2 to FIG. 6 inclusive, latch cam 2 has a shaft 8 integrally formed and normal to the underside or back of its plate portion 7 and this shaft rotatably passes through a central opening 10 in a top wall 9 of the base member 1, and through a central opening 12 in a washer 11 which closes the back of the base member by caulking the tip 13 of the shaft, it is pivotally attached to the base member.

Between the base member 1 and the washer 11, there is a space 14, in which two leaf springs 15 are secured to the underside of the base member so as to pinch the rotatable shaft 8 elastically. A flat side face 16 is formed on the rotatable shaft 8 and when the latch cam 2 is located either in engaged position with the keeper or in a position disengaged therefrom, the leaf spring 15 engages with the flat side face 16 of the rotatable shaft to keep the latch cam in the respective positions.

Cylindrical casing 3 has projections 17 on its lower end, and these projections are inserted in openings 18 of the plate portion 7 of the latch cam 2 and are secured by caulking the tip of the projections. Within casing 3, there is provided a locking means as follows. The rotatable barrier disk 5 having the key hole 6 engages with a flange 19 inwardly projecting at the top of the casing 3, and is kept thereby so as not to get out from an opening 20 at this top of the casing. A locking member 21, which can lock latch cam 2 so as not to rotate relative to the base member 1, is located between rotatable barrier disk 5 and the plate portion 7 of latch cam 2, and has a body 33 having an annular (peripheral) face. Two legs 23 extend from said body parallel to cam shaft 8, at diametrically opposite points of the body. Said legs 23 are always inserted in two guide openings 24 of the plate portion 7 of the latch cam 2, and are slidable in these openings to shift the locking member 21 only in axial directions.

When locking member 21 slides into a lowered position, the two lower ends of the legs 23 engage within two notches or recesses 25, which are symmetrically formed around the central opening 10 of the base member 1, thus to lock the latch cam 2. When the locking member 21 slides into a raised position, the lower ends of the legs 23 do not engage with the recesses 25, and the latch cam 2 is then rotatable, being unlocked. Between the locking member 21 and the latch cam 2, a coiled compression spring 26 is provided and it acts so as to shift the locking member upwards into unlocked position. Between rotatable barrier disk 5 and locking member 21, an actuating member 27 is provided to shift locking member 21 into its locked and unlocked positions by rotation of the actuating member while the spring 26 tends to keep the locking member raised.

To convert the rotary motion of actuating member 27 into the axial rectilinear motion of locking member 21, the actuating member and the locking member are provided with mutually engageable cams. The cam of actuating member 27 comprises two projections on the lower face of the body 28 each having a configuration similar to a saw-tooth, comprising a lower (recessed) flat cam surface 29, an inclined cam surface 30 continuous to said lower flat cam surface 29, a higher (projecting) flat cam surface 31 continuous to said inclined cam surface 30, and an upright cam surface 32 continuous to said higher flat cam surface 31.

The cam of locking member 21 similarly two projections on the upper face of body 33, each having a lower (recessed) flat cam surface 34, which may engage with the higher flat cam surface 31 of actuating member 27, an inclined cam surface 35 which is continuous to lower flat cam surface 34 and may engage with the inclined cam surface 30 of the actuating member, a higher (projecting) flat cam surface 36 which is continuous to inclined cam surface 35 and may engage with the higher flat cam surface 31 and with the lower flat cam surface 29, and an upright cam surface 37 which is continuous to higher flat cam surface 36 and may engage with the upright cam surface 32 of the actuating member.

Figure 2:
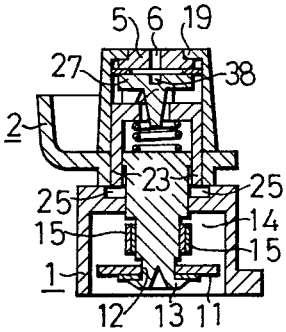
FIG. 2 is a vertical longitudinal section of the lock of FIG. 1, showing it in the same state.
Figure 5:
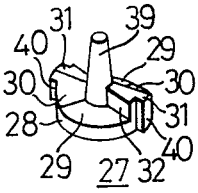
FIG. 5 is a perspective view of an actuating member turned upside down.

When the higher flat cam surface 31 of actuating member 27 engages with the lower flat cam surface 34 locking member 21, as shown in FIG. 2, the locking member 21 is in its higher position, namely its unlocked position, and the legs 23 of the locking member do not engage with the recesses 25 of the base member 1, but engage with the guide openings 24 only, thus the latch cam 2 is unlocked. In this unlocked state, the actuating member 27 is rotated clockwise by inserting the key 4 through key hole 6 of rotatable barrier disk 5 into a key hole 38 of the actuating member and turning the key clockwise. Accompanied with this rotation of actuating member 27, the inclined cam surface 30 of the actuating member 27 slides on the inclined cam surface 35 of locking member 21 to push down this member against elasticity of the spring 26, thus the higher flat cam surface 31 of actuating member 27 is engaged with higher flat cam surface 36 of the locking member 21. The locking member 21 is thereby shifted downwards to the extent of the height of both higher flat cam surfaces 31 and 36, and legs 23 thereof then engage with both of the guide openings 24 of the latch cam 2 and the recesses 25 of the base member. Thus the latch cam 2 is locked.

In this locked state, when the actuating member 27 is turned counterclockwise by the key 4, the higher flat cam surface 31 of actuating member 27 is disengaged from the high flat cam surface 36 of locking member 21 to engage with the lower flat cam surface 34 of locking member 21 while the higher flat cam surface 36 of locking member 21 will engage with the lower flat cam surface 29 of actuating member 27. Thereby locking member 21 is raised by coiled spring 26 to the extent of the height of both of higher flat cam surfaces 31 and 36 into the original unlocked position, to disengage its legs 23 from the recesses 25 of the base member, thus the latch cam 2 is unlocked.

Actuating member 27 has a shaft 39, which integrally extends axially from the lower face of body 28, and has two projections 40 integrally extending radially from the periphery of the body 28. Shaft 39 is rotatably fitted into a central opening 41 of body 33 of locking member 21 rotation relative to actuating member 27 and locking member 21. Projections 40 are extending into a space between two raised portions 42, which are disposed on an inside face of the peripheral wall of casing 3. The projections can rotate between these portions to limit rotation of actuating member 27. In the embodiment shown in the drawings, the rotation is limited to 90°, and when the projections 40 abut against one of raised portions 42, the locking member 21 is in locked position, when the projections abut against another raised portion 42, the locking member 21 is in unlocked position.

Between actuating member 27 and rotatable barrier disk 5, there is provided a washer 43, which has a central opening 44 for rotation of the key 4 within, and slots or notches 45 on its periphery. Slots 45 fit the raised portions 42 within the casing 3 to prevent the washer 43 from rotation relative to the casing 3. If any improper key, driver, coin, or the like is inserted into the key hole 6 of the barrier disk 5 to turn the actuating member 27 by the mere application of frictional force between the barrier disk and the actuating member, (pushing the barrier disk 5 on the actuating member 27 and turning the disk), washer 43 prevents the turning force of the barrier disk 5 from being transmitted to the actuating member 27, and thus the actuating member 27 will not be rotated. Therefore, the latch cam 2 cannot be unlocked by any key other than the regular one, inserted with member 27 itself.

In case that the rotatable barrier disk 5 and the actuating member 27 are made of metallic material and the coefficient of friction between them is relatively large, washer 43 is effectively used to lessen the coefficient of friction. However, in case that the actuating member is made of synthetic resin having self-lubricating property with small coefficient of friction, washer 43 may be eliminated and barrier disk 5 may contact directly the actuating member 27. In addition, the frictional resistance between the cam surface of actuating member 27 and the cam surface of locking member 21 is thereby, and it becomes possible to turn the actuating member 27 lightly.

Figure 7:
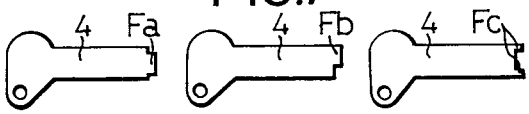
FIG. 7 is a front view, showing various profiles of keys usable in the lock.
Figure 8:
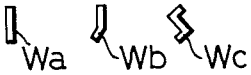
FIG. 8 is a sectional view, showing various sectional shapes of such keys.

The tip of key 4 may have various profiles (F*a*), (F*b*), (F*c*) and the like, as shown in FIG. 7, and may be formed with various sectional shapes (W*a*), (W*b*), (W*c*) and the like as shown in FIG. 8, thus a large number of different keys may be provided by combining these profiles and shapes.

Figure 9:
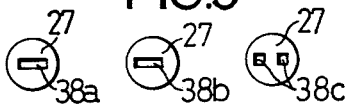
FIG. 9 is a plan, showing various shapes of upper portion of actuating members according to FIG. 5.

The key hole 6 of the barrier disk 5 is formed to tally or correspond with one kind of sectional shape of the key so that it can be traversed only by the key having a corresponding sectional shape, and the key hole 38 of the actuating member 27 is formed into shapes **38*a*, 38*b*, 38*c* to tally or correspond with the profiles of the key, so that it can only be engaged with the tip of one proper key among a plurality of keys having the corresponding sectional shape as shown in FIG. 9**.

Figure 10:
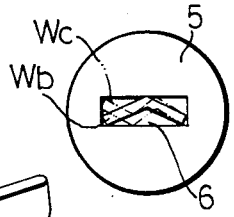
FIG. 10 is an enlarged plan, showing the combination of a key with a key hole of the actuating member.
Figure 3:
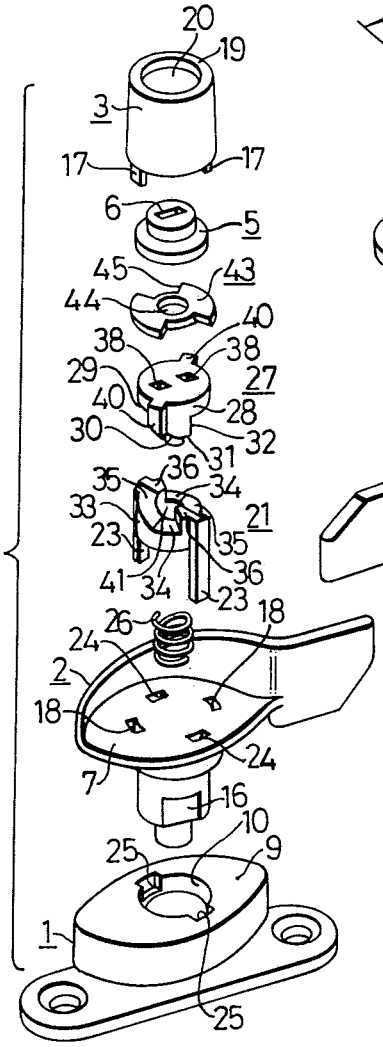
FIG. 3 is an exploded perspective view of the lock of FIG. 1.

The width of the key hole 6 of barrier disk 5 may be made somewhat larger than the thickness of the key 4 so that keys having different sectional shapes may be inserted into said key hole. FIG. 10 shows one such case, wherein either of two different keys, having two kinds of sectional shapes (Wb), (Wc), can be inserted into the key hole 6 of the barrier disk 5.

Figure 11:
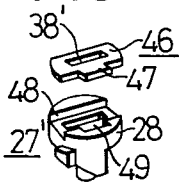
FIG. 11 is a perspective view, showing another example of an actuating member.
Figure 6:
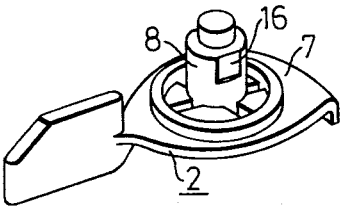
FIG. 6 is a perspective view of the latch cam turned upside down.
Figure 4:
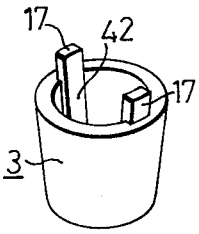
FIG. 4 is a perspective view of a cylinder forming part the lock, turned upside down.

In case the key hole 38' is not formed directly in body 28 of actuating member 27, but the key hole 38' is formed in a plate 46 which may be separated from body 28 of said actuating member 27, a large number of plates 46 having various key holes may be formed and these plates may be combined with the body 28 of a common actuating member 27, thus the production of actuating member is simple (FIG. 11). Plate 46 may be a rectangular sheet, its key hole 38' may be similar to the key hole 38 of the actuating member 27 as mentioned above; a projection 47 is formed on its periphery. On upper face of the body 28, of the corresponding actuating member 27', there are formed a groove recess 48 in which said plate 46 will fit notch or recess and a 49 of groove 48, in which projection 47 will fit; and both members 27 and 46 will be integrally joined by inserting said plate 46 into these recesses 48 and 49.

It is to be understood that the present invention is not limited to the above mentioned embodiments thereof, but may be otherwise variously modified within the scope of the invention set forth in the following claims.

What is claimed is:

1. A sash lock, comprising; a base; a rotatable latch cam pivoted to the base; a locking member disposed on the latch for unlockably locking the latch cam to control rotation thereof; a rotatable actuating member disposed on the locking member; and a key for rotating the actuating member to shift the locking member into and between locking and unlocking positions thereof, each of said members having a cam surface, one such surface being engageable with the other and normally engaged therewith to derive from the rotating of the actuating member a rectilinear motion of the locking member between the locking and unlocking positions thereof, and wherein each cam surface has a recessed flat cam surface portion, an inclined cam surface portion connected to said recessed one, and a projecting flat cam surface portion connected to said inclined one so that, when the projecting flat cam surface portions are mutually engaged, the locking member is in the locking position, and when a projecting flat cam surface portion and a recessed flat cam surface portion are mutually engaged, the locking member is in the unlocking position thereof.

2. A sash lock according to claim 1, wherein said latch cam has a guide opening for said locking member and said base member has a recess engageable with said locking member, and wherein by engaging said locking member with both said guide opening and said recess, the latch cam is locked to the base, and by disengaging said locking member from the recess, the latch cam is unlocked.

3. A sash lock according to claim 2, including a coiled compression spring disposed between said latch cam and said locking member to urge the locking member toward the unlocking position, said spring cooperating with mutually engaging surfaces of said actuating member and of said locking member to shift said locking member between the locking and unlocking positions.

4. A sash lock, comprising; a base; a latch cam pivoted to said base; a locking member on the latch cam for unlockably locking said latch cam to the base; a coiled compression spring provided between said locking member and said latch cam and biassing them in an unlocking direction; an actuating member disposed on the locking member, rotatable by a key and enabled thereby in one rotational position of the actuating member to shift said locking member to a locking position thereof, against the biasing of the spring and for permitting the spring, in another rotational position of the actuating member, to shift the locking member to an unlocking position thereof; and a casing fixed to said latch cam to cover said locking member, spring and actuating member and to retain the members against the biasing of said coiled compression spring.

5. A sash lock according to claim 4, wherein said casing has a flange extending into an end portion thereof for the retaining of the actuating member and locking members biassed by said spring.

6. A sash lock according to claim 5, including a rotatable barrier disk having a key hole and disposed between the flange of said casing and the actuating member, said flange having an inside circumference defining a hole in which the key can be rotated.

7. A sash lock according to claim 4, wherein said actuating member and said locking member have mutually engageable cam surfaces to shift the locking member between the locked position and the unlocked position thereof by rotation of said actuating member.

8. A sash lock according to claim 7, wherein said locking member has a body and legs axially extending from an end face of said body, the corresponding cam surface being disposed on another end face of said body, said actuating member having a body, one end face of which has the cam surface thereof and another face of which has said key hole, said latch cam having guide openings to guide the legs of the locking member in the locking and unlocking directions, and said base having recesses alignable with said guide openings so that, when said guide openings and said recesses are aligned, the legs can enter the recesses to lock the latch cam.

9. A sash lock according to claim 8, wherein said actuating member has outer projections extending from its body in radial directions so that the projections can rotate with the actuating member within the casing, and has a rotary shaft extending axially from an end face, on which face the corresponding cam surface is provided, said casing having inner projections on an inside face of a wall thereof, and the rotation of the actuating member being limited by abutting of said outer and inner projections against one another.

10. A sash lock according to claim 9, wherein said actuating member is made of synthetic resin having self-lubricating property.

11. A sash lock according to claim 9, including a non-rotatable washer disposed between said rotatable barrier disk and said actuating member.

12. A sash lock according to claim 11, wherein said washer has peripheral recesses engageable with the inner projections of the casing, whereby the washer is rotably joined with the casing.

13. A sash lock according to claim 8, wherein the key hole of said actuating member is recessed into the body of the actuating member.

14. Sash lock according to claim 8, wherein the actuating member has an actuating plate connected with the body of the actuating member and which is recessed to provide the key hold for that member.

15. Sash lock according to claim 14, wherein said actuating member is recessed to receive the actuating plate, and to contact said plate so that the plate is integrally connected with the actuating member.

* * * * *